United States Patent [19]

Maissant

[11] Patent Number: 5,005,537

[45] Date of Patent: Apr. 9, 1991

[54] METHOD AND DEVICE FOR INTRODUCING A CARBURETTED MIXTURE UNDER PRESSURE IN A CHAMBER OF A TWO-STROKE ENGINE

[76] Inventor: Jean-Pierre Maissant, 12bis, rue du General Noel, 92500 Rueil Malmaison, France

[21] Appl. No.: 459,300

[22] Filed: Dec. 29, 1989

[30] Foreign Application Priority Data

Dec. 30, 1988 [FR] France ..... 88 17601

[51] Int. Cl.[5] ..... F02M 67/00; F02M 69/10

[52] U.S. Cl. ..... 123/65 VB; 123/73 BA; 123/90.14

[58] Field of Search ..... 123/90, 14, 73 BA, 73 B, 123/73 PP, 65 VB, 65 VD

[56] References Cited

U.S. PATENT DOCUMENTS

| | | | |
|---|---|---|---|
| 896,439 | 8/1908 | Criner | 123/90.14 |
| 955,786 | 4/1910 | Frear | 123/90.14 |
| 1,361,109 | 12/1920 | Spohrer | 123/90.14 |
| 1,525,187 | 2/1925 | Indlekofer | 123/73 BA |
| 2,719,516 | 10/1955 | Clark | 123/90.14 |
| 4,852,528 | 8/1989 | Richeson et al. | 123/90.14 |

FOREIGN PATENT DOCUMENTS

| | | | |
|---|---|---|---|
| 2804771 | 8/1978 | Fed. Rep. of Germany | 123/90.14 |
| 386706 | 1/1908 | France | 123/73 BA |
| 13479 | 12/1906 | United Kingdom | 123/73 BA |

*Primary Examiner*—David A. Okonsky
*Assistant Examiner*—Weilun Lo
*Attorney, Agent, or Firm*—Antonelli, Terry, Stout & Kraus

[57] ABSTRACT

A device, and method for introducing a carburetted mixture under pressure into a chamber of a first cylinder of a two stroke-internal combustion engine. The device includes a feed valve cooperating with a seat for closing a duct feeding carburetted mixture into the chamber of a first cylinder, a valve returning arrangement and an assistance member comprising a separation element cooperating with one end of a stem of the valve. The assistance member separates a first volume and a second volume within each of which a pressure prevails, with the separation element having a movement and causing displacement of the valve under the action of the pressure difference between the pressure of the first volume and the pressure of the second volume.

19 Claims, 2 Drawing Sheets

METHOD AND DEVICE FOR INTRODUCING A CARBURETTED MIXTURE UNDER PRESSURE IN A CHAMBER OF A TWO-STROKE ENGINE

BACKGROUND OF THE INVENTION

The present invention relates to a method and device for introducing a carburetted mixture under pressure in a chamber of a cylinder of a two stroke-internal combustion engine.

More particularly, the present invention provides an assistance device for controlling an automatic valve disposed between the end of a mixture feed duct and the chamber of the cylinder.

The use of valves is known, such as flaps or shutters, which cooperate with return means actuated under the effect of the pressure differences between each of the faces, for introducing a carburetted mixture in the chamber of a cylinder. However, because in particular of the inertial forces compared with the forces due to the pressure differences and possible unsteadiness of the return means when their operating frequency is close to their resonance frequency, these valves cannot be used when the pressure differences are too low and when the operating speed is too high.

The present invention provides a device having more particularly the advantages of prior automatic valve devices, such as thermal resistance, rapid opening and wide passage and which can be used in particular when the pressure difference between the chamber and the cylinder and the carburetted mixture feed duct is small.

SUMMARY OF THE INVENTION

The device for introducing a carburetted mixture under pressure in a chamber of a cylinder of a two-stroke internal combustion engine in accordance with the present invention offers the further advantage of being responsive to the pressure variations of an element of the engine, this element being judiciously chosen for optimum operation of the device.

More precisely, this device comprises a valve cooperating with a seat for closing a duct feeding carburetted mixture into the chamber of a first cylinder, means for returning the valve, an assistance member comprising a deformable and possibly flexible membrane cooperating with one end of a stem of the valve, the membrane separating a first volume and a second volume within each of which a pressure prevails, the membrane having a movement and causing displacement of the valve under the action of the pressure difference between the pressure of the first volume and the pressure of the second volume.

The valve has a tulip portion and, in the present text, the tulip portion means that the portion of the valve having a widened shaped, as opposed to the stem which is the portion of the valve having a tapered shaped.

This membrane in fact plays the role of element separating the two volumes. Without departing from the scope of the present invention, this membrane may be replaced by an auxiliary piston which slides in a bore, one face of this auxiliary piston participating in defining the first volume, the other face in defining the second volume.

The first volume may be connected to the feed duct so that the pressure in the first volume is substantially equal to the pressure in the duct.

The second volume may be connected to a crankcase pump of the first cylinder so that the pressure in the second volume is substantially equal to the pressure in the crankcase-pump of the first cylinder.

The engine may have at least a second cylinder with a crankcase-pump, the feed duct into the chamber of the first cylinder may be connected to the crankcase-pump of the second cylinder and the second cylinder may have an angular non zero shift retarded with respect to the first cylinder.

The second volume may be connected to an element of the engine whose pressure relatively to the pressure of the first volume is such that it contributes favorably to displacement of the valve.

The engine may comprise at least a third cylinder with a crankcase-pump and whose cycle is advanced with respect to the cycle of the first cylinder and the crankcase-pump of the third cylinder may be connected to said second volume.

The valve may be returned to its closed position by the membrane itself, whose elasticity may bring the valve back to its closed position. The membrane may be reinforced so as to increase its rigidity.

The separation element may have a useful cross-section greater than the cross-section of the valve.

The feed duct may comprise a fuel feed member.

The duct may open in the vicinity of the cylinder head of the first cylinder.

The engine may comprise several cylinders each having a crankcase-pump fed with air through an air feed duct, this air duct comprising an element adapted for reducing the air intake, and the portion of the air duct common to several cylinders and situated downstream of the element adapted for reducing the air intake may be connected to the second chamber of the assistance member.

The present invention further provides a method for introducing a carburetted mixture under pressure into a chamber of a first cylinder of a two stroke-internal combustion engine, this engine comprising a valve cooperating with a seat for closing a duct introducing carburetted mixture into the chamber of the first cylinder.

This method is particularly characterized in that a member is used for assisting the displacement of the valve, this member comprising a membrane separating a first volume and a second volume within each of which prevails a pressure, said membrane cooperating with the end of a stem of the valve and having movements under the action of the difference between the pressure of the first volume and that of the second volume, the assistance member further comprising means for returning the valve and in that the first volume is connected to the carburetted mixture feed duct.

BRIEF DESCRIPTION OF THE DRAWINGS

The present invention will be well understood and its advantages will be clear from the following description of a non limitative example of the device, illustrated by the accompanying figures in which.

DESCRIPTION OF THE PREFERRED EMBODIMENTS

Figure 1:
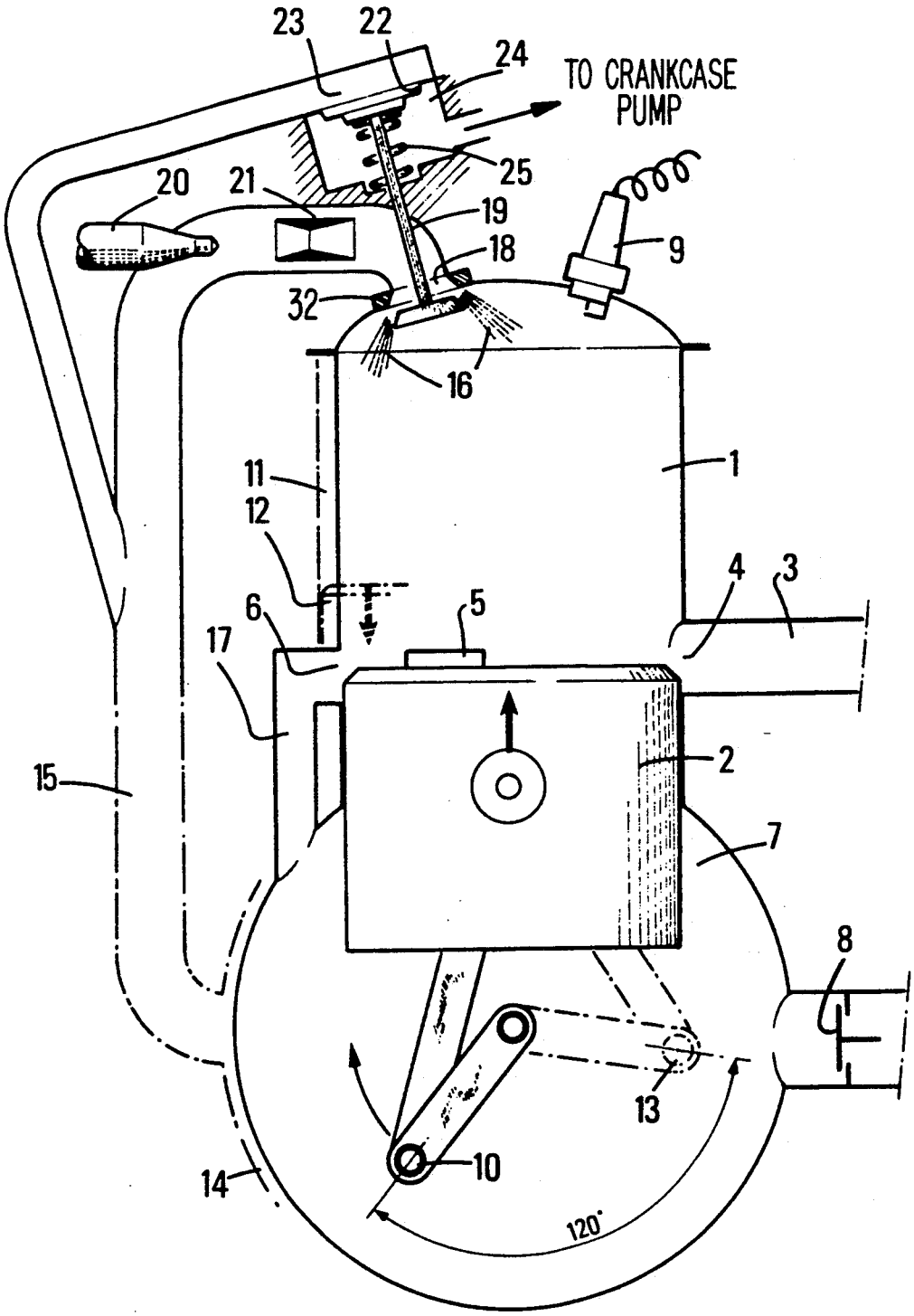
FIG. 1 shows an arrangement of a spark ignition two-stroke engine comprising the device of the present invention.

FIG. 1 shows, with continuous lines, the cylinder considered 1 with its piston 2 at the end of scavenging, its exhaust 3, its exhaust port 4 which is about to be closed, its lateral 5 and rear 6 transfer ports, its crankcase 7 with one air intake only, for example through valves 8, its spark plug 9, its connecting rod-crank system 10.

The second cylinder 11 is shown with a chain-dotted line, having a piston 12 whose movement is retarded angularly by 120° via the connecting rod-crank system 13, with respect to the piston 2 of the cylinder considered 1. Piston 12 is in the expansion phase in the second cylinder 11 and at the same time in the compression phase in the crankcase-pump 14.

The crankcase-pump 14 in which the movement of piston 12 is retarded angularly by 120° feeds the chamber 16 of the cylinder considered 1 with air through the feed duct 15. The rear transfer port 6 of cylinder 1 is connected to the crankcase-pump and to cylinder 1 through a duct 17.

Pressurized air from the crankcase-pump is fed into chamber 16 through an orifice 18 whose opening is controlled by a mobile valve 19 cooperating with a fixed seat. Upstream of valve 19 is disposed a device 20 for feeding and proportioning fuel at low pressure.

This device may be a low pressure injector which is available commercially, a fuel pump actuated by the successive pressures and depressions of a crankcase-pump.

The liquid fuel may be fed into duct 15, not only all the time valve 19 is closed but also when it is open.

This fuel proportioning and feed device 20 may be associated with a venturi nozzle 21 placed in duct 15, just upstream of valve 19 and orifice 18, in accordance with the patent EP-189 714, so as to improve spraying of the fuel by the air from the pressure source (crankcase pump).

Without departing from the scope of the present invention, device 20 may be replaced by a carburetor, the venturi nozzle 21 being integrated in this carburetor.

Just downstream of orifice 18 a deflector 32 may be advantageously mounted on a device for orienting the jet of mixture fed into the cylinder. This device, forming part of the cylinder head or being fixed to the cylinder head, is of the type described in the patent EP-189 715.

The end of the stem of valve 19 is connected to the center of a flexible membrane 22 which separates a first volume 23 from a second volume 24 in which the difference between their respective pressures may produce movements of the membrane and thus displacement of valve 19 to which it is connected. The valve cooperates with a spring 25 for automatically returning valve 19 to a position in which the carburetted mixture feed duct 15 is closed.

The first volume 23 is connected to duct 15 so that a pressure in the crankcase-pump 14 acts both on the face of membrane 22 directed towards the first volume, producing a force tending to open valve 19 and on the upper face of the tulip of valve 19, the upper face of the tulip of valve 19 being opposite the lower face of the tulip of the valve, this lower face being directed towards the inside of chamber 16.

The second volume 24 may have its pressure constant, for example equal to the atmospheric pressure, for example by connecting this second volume to the atmosphere or may have its pressure variable for promoting opening, or maintenance in the open position of valve 19 or closure or maintenance thereof in the closed position, depending on the different phases of displacement of the valve. This variable pressure which may be established in this second volume 24 may be dispensed by the crankcase-pump 7 of the cylinder considered 1, or by the crankcase-pump of a cylinder whose cycle is angularly advanced by 90° or 120° with respect to the cycle of the cylinder considered 1.

The variations of intensity of the resultant of the forces, particularly of the pressure acting on each side of the membrane, as well as the pressure acting on each side of the tulip of the valve, causes opening variations of valve 19 and so the sequential intake of carburetted mixture coming from the feed duct 15 and going into the combustion chamber 16 of the cylinder considered 1.

Figure 2:
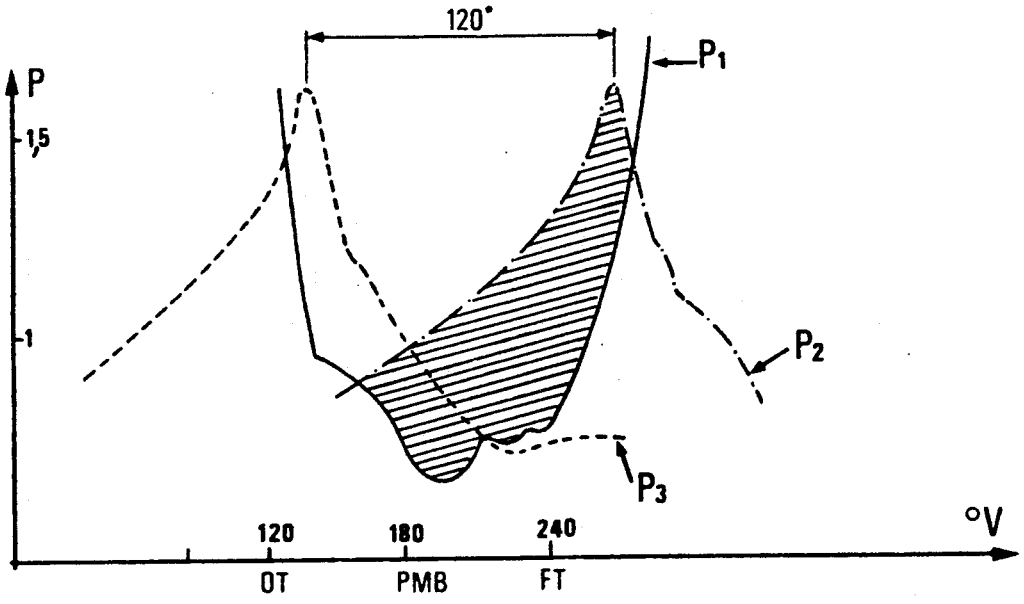
FIg. 2 shows the evolution of the pressures in several cylinders whose use makes possible a particularly advantageous implementation of the device of the present invention.

FIG. 2 shows variations of the pressure in different volumes of the engine, as a function of the crank angle of the cylinder considered 1.

The continuous line curve reference P1 shows the variations of the pressure in the chamber of the cylinder considered 1, the broken line curve referenced P3 shows the variation of the pressure in the crankcase-pump 7 of the cylinder considered and the curve shown with a chaindotted line and referenced P2 shows the variation of the pressure in the crankcase-pump 14 of the cylinder 11 whose cycle is retarded by 120° with respect to the cycle of cylinder 1.

FIG. 2 shows clearly that between about 155° and 250° of crank angle of cylinder 1, the pressure P2 in the crankcase-pump 14 is higher than the pressure P1 in the chamber of cylinder 1 and that a carburetted air flow occurs through the injection duct 15, as soon as valve 19 opens.

FIG. 2 further shows that from about 180° up to 275° of crank angle, the pressure P3 in the crankcase-pump 7 of the cylinder considered 1 is less than the pressure P2 in the carburetted air feed duct and that this depression may be used for opening the valve if it is connected to chamber 24.

The choice particularly of the effective cross section of membrane 22, the calibration of the return means 25, the cross-section of the tulip of the valve, the connection of the second volume 24 to an engine element, such as the crankcase-pump 7 of cylinder 1, must be adapted to each engine so as to obtain the desired displacement of the valve. In fact, the pulsatory, vibratory phenomena of the different elements of an engine, such as the feed duct 15 and proper to each engine, greatly modify the displacement of the valve comprising the assistance device of the present invention.

In the same way that the pressure of the crankcase-pump of a cylinder retarded by 120° is used for supplying chamber 16, the pressure of a crankcase-pump of a cylinder may be used whose cycle is retarded by 90°, as is described in the French patent application 87/09035. The pressure of the crankcase-pump of a cylinder may also be used whose cycle is advanced by 90° or 180° with respect to the cycle of the cylinder considered for supplying the second volume 24.

Without departing from the scope of the present invention, the return means may be considered as comprising membrane 22 and the second volume 24, when the pressure in this volume is greater than the pressure in the first volume 23 and causes return of the valve to a closed position.

What is claimed is:

1. A device for introducing a carburetted mixture under pressure into a chamber of a first cylinder of a two-stroke internal combustion engine, the device comprising a valve having a first end cooperating with a seat for closing a feed duct feeding the carburetted mixture into the chamber of the first cylinder, means for returning the valve, an assistance member comprising a separation element cooperating with one end of a stem of the valve opposite said first end, said assistance member separating a first volume and a second volume within each of which a pressure prevails, the separation element being displaceable and causing displacement of the valve under an action of a pressure difference between the pressure of the first volume and the pressure of the second volume, and means for connecting said feed duct to said first volume so that the pressure in said first volume is substantially equal to the pressure in said feed duct.

2. A method for introducing a carburetted mixture under pressure into a chamber of a first cylinder of a two-stroke internal combustion engine, the method comprising the steps of closing a feed duct introducing the carburetted mixture into the chamber of the first cylinder by a valve having a first end cooperating with a valve seat of the feed duct, assisting a displacement of the valve by an assisting member comprising a separation element cooperating with an end of a stem of the valve opposite said first end and separating a first volume and a second volume within each of which prevails a pressure, allowing movement of the separation element under an action of a difference between the pressure of the first volume and the pressure of the second volume, connecting said first volume to said carburetted mixture feed duct so that the pressure in said first volume is substantially equal to the pressure in said feed duct, and providing a valve returning means for enabling a return to an initial position.

3. The device as claimed in claim 1, wherein means are provided for connecting said second volume to a crankcase pump of the first cylinder so that the pressure in said second volume is substantially equal to a pressure in the crankcase pump of said first cylinder.

4. The device as claimed in claim 1, wherein the internal combustion engine has at least a second cylinder with a crankcase pump, means are provided for connecting the feed duct into the chamber of said first cylinder to the crankcase pump of the second cylinder, and wherein said second cylinder has an angular nonzero shift retarded with respect to said first cylinder.

5. The device as claimed in one of claims 1, 3 or 4, wherein means are provided for connecting said second volume to an element of the engine having a pressure relative to the pressure of the first volume so as to contribute to the displacement of the valve.

6. The device as claimed in one of claims 1, 3 or 4, wherein said internal combustion engine comprises at least a third cylinder with a crankcase pump and having a cycle advanced with respect to the cycle of the first cylinder, and wherein means are provided for connecting the crankcase pump of the third cylinder to said second volume.

7. The device as claimed in one of claims 1, 3 or 4, wherein said separation element is a membrane.

8. The device as claimed in one of claims 1, 3 or 4, wherein said separation element has a cross-sectional area greater than a cross-sectional area of the valve.

9. The device as claimed in one of claims 1, 3 or 4, wherein said feed duct comprises a fuel feed member.

10. The device as claimed in one of claims 1, 3 or 4, wherein said feed duct opens in a vicinity of a cylinder head of said first cylinder.

11. The device as claimed in one of claims 1 or 3 wherein said internal combustion engine comprises several cylinders, each of said cylinders having a crankcase pump fed with air through an air feed duct, and wherein said air feed duct comprises an element adapted for reducing the air intake, and wherein means are provided for connecting a portion of the air feed duct common to several cylinders and located downstream of said element adapted for reducing the air intake to the second chamber of the assistance member.

12. The device as claimed in claim 11, wherein said separation element is a piston.

13. The device as claimed in claim 7, wherein said means for returning the valve comprises said membrane.

14. The device as claimed in claim 5, wherein said internal combustion engine comprises at least a third cylinder with a crankcase pump and having a cycle advanced with respect to the cycle of the first cylinder, and wherein means are provided for connecting the crankcase pump of the third cylinder to said second volume.

15. The device as claimed in claim 14, wherein said separation element is a membrane.

16. The device as claimed in claim 14, wherein said separation element has a cross-sectional area greater than a cross-sectional area of the valve.

17. The device as claimed in claim 14, wherein said feed duct comprises a fuel feed member.

18. The device as claimed in claim 5, wherein said feed duct opens in a vicinity of a cylinder head of said first cylinder.

19. The device as claimed in claim 14, wherein said separation element is a piston.

* * * * *